United States Patent [19]

Matsumura et al.

[11] Patent Number: 4,573,442

[45] Date of Patent: Mar. 4, 1986

[54] FUEL INJECTION PUMP HAVING A COMPACT SPILL-PORT TIMING CONTROL UNIT

[75] Inventors: Toshimi Matsumura, Aichi; Masahiko Miyaki, Oobu; Akira Masuda, Aichi, all of Japan

[73] Assignee: Nippondenso Co., Ltd., Kariya, Japan

[21] Appl. No.: 501,789

[22] Filed: Jun. 7, 1983

[30] Foreign Application Priority Data

Jun. 10, 1982 [JP] Japan ..... 57-101178
Jul. 21, 1982 [JP] Japan ..... 57-127128
Aug. 25, 1982 [JP] Japan ..... 57-147175

[51] Int. Cl.[4] ..... F02M 59/20

[52] U.S. Cl. ..... 123/450; 123/357; 123/503

[58] Field of Search ..... 123/450, 449, 357–359, 123/503, 501, 500, 506; 417/462

[56] References Cited

U.S. PATENT DOCUMENTS 3,797,469 3/1974 Kobayashi ..... 123/357
3,999,529 12/1976 Davis ..... 123/449
4,036,193 7/1977 Kobayashi ..... 123/357
4,211,520 7/1980 Kranc ..... 123/500
4,406,263 9/1983 Leblanc ..... 123/357

*Primary Examiner*—Carl Stuart Miller
*Attorney, Agent, or Firm*—Cushman, Darby & Cushman

[57] ABSTRACT

In a fuel injection pump, an engine drives a rotary plunger having an axially extending bore connected to a compression chamber, plural fuel inlet ports alignable with an inlet passage for introducing fuel to the compression chamber, fuel distribution ports for distributing the compressed fuel through the bore to each one of the fuel delivery passages and plural spill ports. A spill-port timing control unit is provided comprising a stator core, a coil wound on thereon, a magnetized ring having a spill groove, and a spring for resiliently maintaining the ring in a reference angular position with respect to the stator core. The magnetized ring is mounted on the plunger so that it can rotate from the reference angular position to an angularly displaced position in proportion to the magnetic flux of the coil to align the spill groove of the ring with each spill port of the plunger to create a passageway through which the compressed fuel is allowed to escape at the termination of fuel injection.

23 Claims, 9 Drawing Figures

FUEL INJECTION PUMP HAVING A COMPACT SPILL-PORT TIMING CONTROL UNIT

BACKGROUND OF THE INVENTION

The present invention relates to fuel injection pumps of the distribution type wherein a plunger having a spill port is driven by the output shaft of a Diesel engine to determine the end timing of injected fuel, and more specifically to a fuel injection pump having a compact spill-port timing control unit.

The spill-port timing control unit of known distribution type fuel injection pumps for Diesel engines comprises a spill ring movably mounted on the rotary plunger of the pump and a centrifugal governor that axially moves the ring to bring its spill port into alignment with a spill port of the plunger to allow compressed fuel to escape through the aligned ports to the outside at the end of fuel injection. Another type of spill-port timing unit which has been developed to replace the governor type unit comprises a rotary or linear solenoid having a moving part which is linked to the spill ring by a mechanical means such as levers. This resulted in a relatively complicated mechanism and takes up a substantial amount of space in the fuel pump housing, and as a result the injection pump became bulky. It has therefore been desired to develop a spill-port timing control unit that is easy to manufacture and compact in design without sacrificing the required degree of sensitivity to a control signal applied to the solenoid.

SUMMARY OF THE INVENTION

It is therefore a primary object of the invention to provide a spill-port timing control unit for distribution type fuel injection pumps which takes up as small a space as possible in the injection pump.

A fuel injection pump includes a rotary plunger driven about its axis by an internal combustion engine, the plunger having a plurality of angularly spaced apart spill ports through which pressurized fuel is allowed to escape to the outside of the plunger. The spill-port timing control unit of the invention comprises a stator core, a coil wound on the core adapted to be energized by a current supplied thereto, a magnetized spill ring having a spill groove, and a spring for resiliently maintaining the ring in a reference angular position with respect to the stator core. The magnetized ring is mounted on the plunger so that it can rotate from the reference angular position in proportion to the magnetic flux of the coil to align the spill groove of the ring with each one of the spill ports of the plunger to create a passageway for the escaping fuel.

Preferably, the spill ring is axially movably mounted on the plunger, and its spill groove is part-helically formed on the inner wall of the ring. The ring is provided with a cam for axially displacing it in proportion to the angle of its rotation, whereby the angular displacement of the ring with respect to the reference angular position is greater than the angular displacement of the spill groove of the ring with respect to the spill port of the plunger. This spill ring structure is particularly useful to obtain accurate information on the angular position of the spill ring for precision fuel control, and can be advantageously adapted in a fuel injection pump of the type having an inner cam ring mounted in an angularly adjustable position and a pair of fuel compression pistons which reciprocate in a compression chamber in camming contact with the inner walls of the cam ring. The inner cam ring is adjustably rotated by means of a known timing mechanism to determine the start timing of fuel injection.

In a further preferred form of the invention, the rotary solenoid is mounted on the inner cam ring so that the spill ring rotates with the cam ring to compensate its angular position with respect to the injection start timing.

BRIEF DESCRIPTION OF THE DRAWINGS

The present invention will be described in further detail with reference to the accompanying drawings, in which.

DETAILED DESCRIPTION

Figure 1:
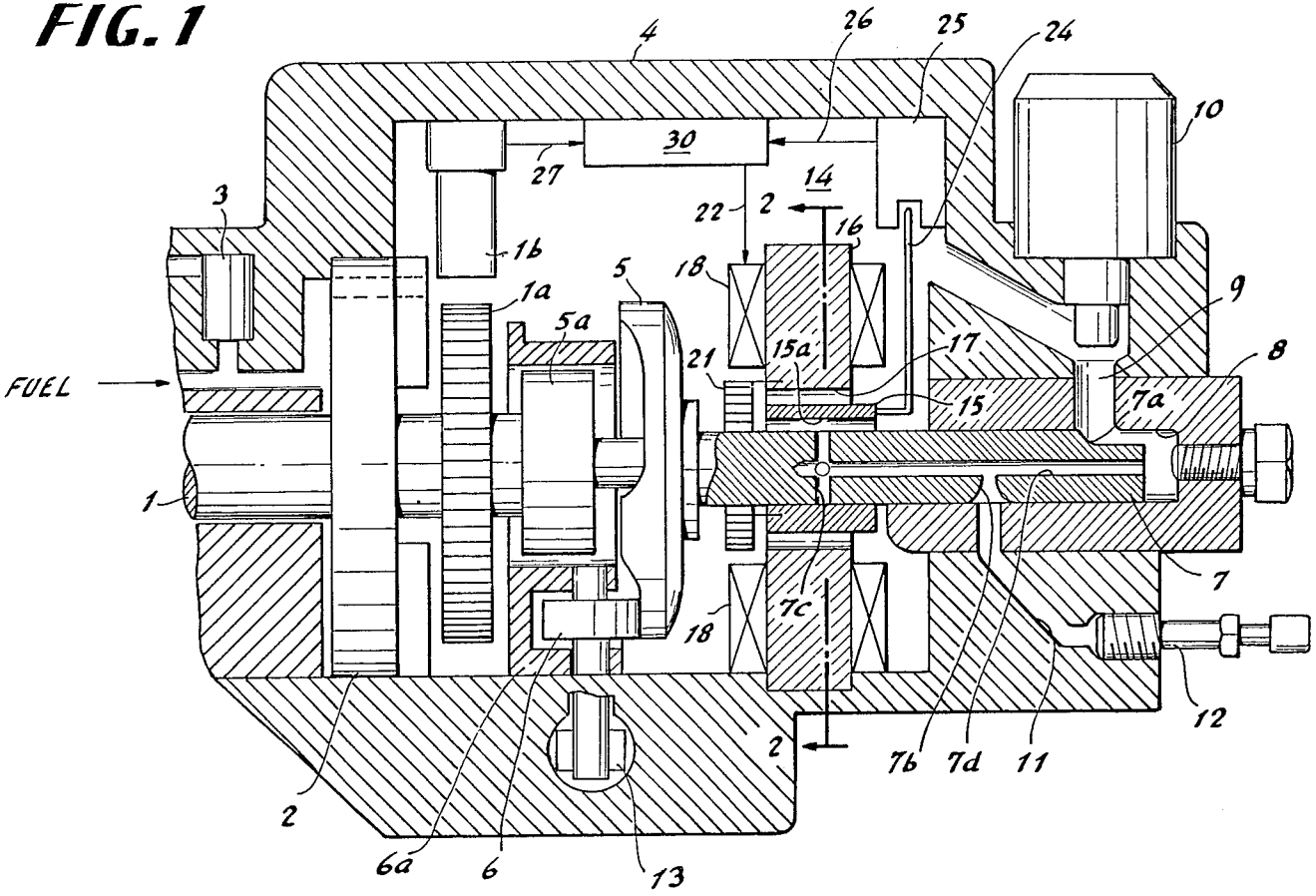
FIG. 1 is an axial cross-sectional view of a fuel injection pump according to a first embodiment of the invention.

Referring to FIG. 1, there is shown a fuel injection pump of the distribution type constructed according to a first embodiment of the invention. Illustrated at 1 is a rotary shaft which is coupled to the output shaft of an internal combustion engine. The shaft 1, when driven by the engine, drives a vane type feed pump 2 to feed fuel under pressure controlled by a regulating valve 3 into the pump housing 4. A toothed wheel of a ferromagnetic material 1*a* is mounted on the shaft 1. A Hall generator 1*b* secured to the pump housing 4 in proximity to the periphery of the wheel 1*a* measures the rotational speed of the shaft 1 by generating pulses in response to variations in magnetic field intensity. A face cam 5 having a plurality of camming surfaces each for an engine cylinder is axially slidably coupled by a known coupling means 5*a* to the drive shaft 1 for rotation therewith while keeping a camming contact with a roller 6 which is mounted within a roller ring 6*a* in an angularly adjustable position with respect to the face cam 5. Therefore, the face cam 5 rotates with the engine shaft and reciprocates in synchronism with the stroke movements of engine pistons. To the face cam 5 is fixedly coupled a plunger 7 extending horizontally to define a compression chamber 8 at the forward end thereof where it is formed with a plurality of axially extending, circumferentially spaced apart inlet ports 7*a* (only one being shown) corresponding in number to engine cylinders. Each of the ports 7*a* comes into alignment with a fuel passage 9 (having a fuel shutoff valve 10 therein) to admit fuel into the chamber 8 when the plunger 7 is moved to an appropriate angular and axial position. When the plunger 7 is moved forwards the fuel is compressed in the chamber 8 and then allowed to escape through an axially extending bore 7*d* and through a distribution port 7*b* to a delivery passage 11, the fuel being passed through a delivery valve 12 to a fuel injector, not shown. The axial bore 7*d* terminates in a plurality of radially extending spill ports 7*c* associated respectively with engine cylinders. As hydraulically operated timimg arrangement 13 of a known structure, located below the face cam 5, is actuated by a well known timing control valve, not shown, to adjust the angular position of the roller 6 with respect to the face cam 5 to control the start timing of fuel injection.

Illustrated at 14 is a spill-port timing control unit, or rotary solenoid 14 constructed according to the present invention. The rotary solenoid 14 includes a magnetized rotor or spill ring 15 rotatably mounted on the rear end portion of plunger 7 having the spill port 7*c*, a stator core 16 having a circular opening 17 for accommodating the rotor 15, and a pair of coils 18 wound on the upper and lower parts of the stator core.

Figure 2:
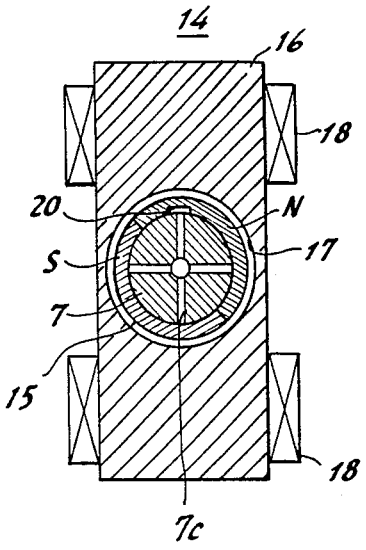
FIG. 2 is a cross-sectional view taken along the lines 2—2 of FIG. 1.
Figure 3:
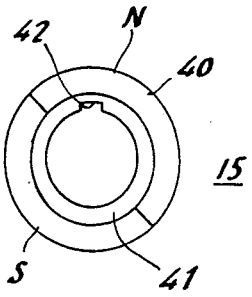
FIG. 3 is an end view of an alternative form of the magnetized spill ring.

As illustrated clearly in FIG. 2, the spill ring 15 is formed with an axially extending spill groove 15*a* on the inner wall thereof. As shown in FIG. 3, the spill ring 15 may alternatively comprise a magnetized outer cylinder 40 and a ferromagnetic inner cylinder 41 having an axial spill port 42.

The spill groove 15*a* comes into alignment with each spill port 7*c* of the plunger 7 to allow the compressed fuel to escape through the aligned spill ports into the pump housing 4 to terminate the fuel injection.

Figure 4:
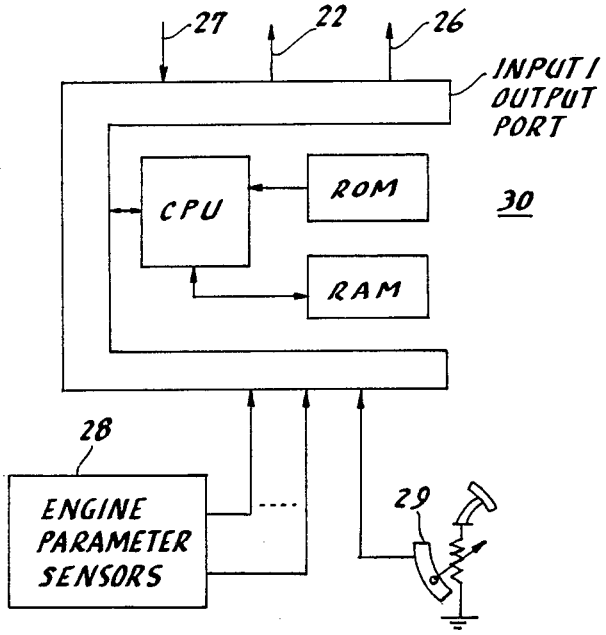
FIG. 4 is a schematic illustration of a fuel injection control circuit.

The coils 18 are connected in circuit through a line 22 to a control unit 30 (FIG. 4) to be energized by a control signal supplied therefrom. The spill ring 15 comprises a pair of magnets N and S which equally divide it along its axial length. The plunger 7 preferably comprises a permalloy or any other ferromagnetic material so that when the coils are not energized it can allow as many magnetic flux lines as possible to pass therethrough to make the spill ring 15 less subject to disturbances in flux density and stably balanced in a predetermined angular position against the force of a spiral spring 21 that couples the spill ring 15 to the stator core 16.

When the coils 18 are energized, the spill ring 15 is caused to rotate from the reference position under the flux-induced thrust until it balances against the spring 21. The angular displacement of the spill ring 15 is thus proportional to the current supplied to the coils 18. It is seen therefore that the time of alignment between each one of the radial spill ports 7*c* and the spill groove 15*a* is adjustably controlled and the amount of fuel injected is determined.

A ferromagnetic needle pointer 24 is attached to the spill ring 15. This pointer extends upwards to a Hall generator or angular position sensor 25 that detects the angular position of the spill ring 15 and provides an r position signal to the control unit 30 through a line 26.

Figure 5:
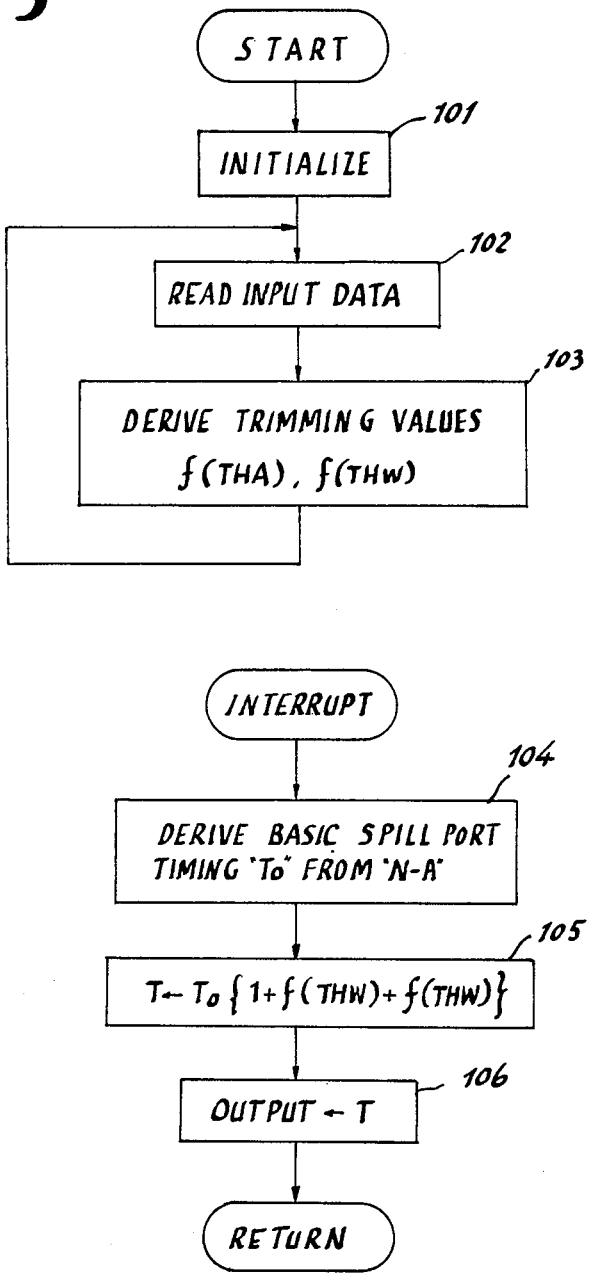
FIG. 5 is a flowchart describing the operation of the control circuit of FIG. 4.

The control unit 30 also receives engine speed signal (N) from the Hall generator 1*b* through a line 27 and other engine parameter signals from known sensors 28 such as engine's operating temperature (THW) and intake air temperature (THA) and an engine load signal (A) from a variable resistor 29 operatively coupled to the accelerator pedal. The control unit 30 preferably comprises a microcomputer including a microprocessor, a read-only memory and a random access memory and an input/output port through which input and output signals are passed. The microcomputer is programmed as shown in the flowchart of FIG. 5 to process on the input signals to compute an optimum fuel injection time and provide a corresponding signal to the coils 18 through line 22 to adjust the angular displacement of the spill ring 15 with respect to the spill ports 7*c*. More specifically, the program includes a main routine in which the microprocessor starts execution at step 101 by initializing the various counter and registers and goes to a step 102 to read the input data mentioned above. At step 103, trimming values f(THA) and f(THW) are derived as a function of the intake air temperature THA and engine temperature THW. The microprocessor returns to step 102 to repeat this process to constantly update the derived trimming values. In response to a pulse from the engine speed sensor 1*b*, the main routine is interrupted and an interrupt routine is initiated. The interrupt routine starts at step 104 in which a basic timing datum (To) for spill port alignment is derived from a map stored in the read only memory as a function of engine speed value N and acceleration angle A. This timing datum is trimmed with the trimming values at step 105 and the trimmed datum is converted at step 106 into a current signal for application to the coils 18.

Therefore, the invention allows a spill control solenoid structure that is easy to manufacture and compact in size.

Figure 6:
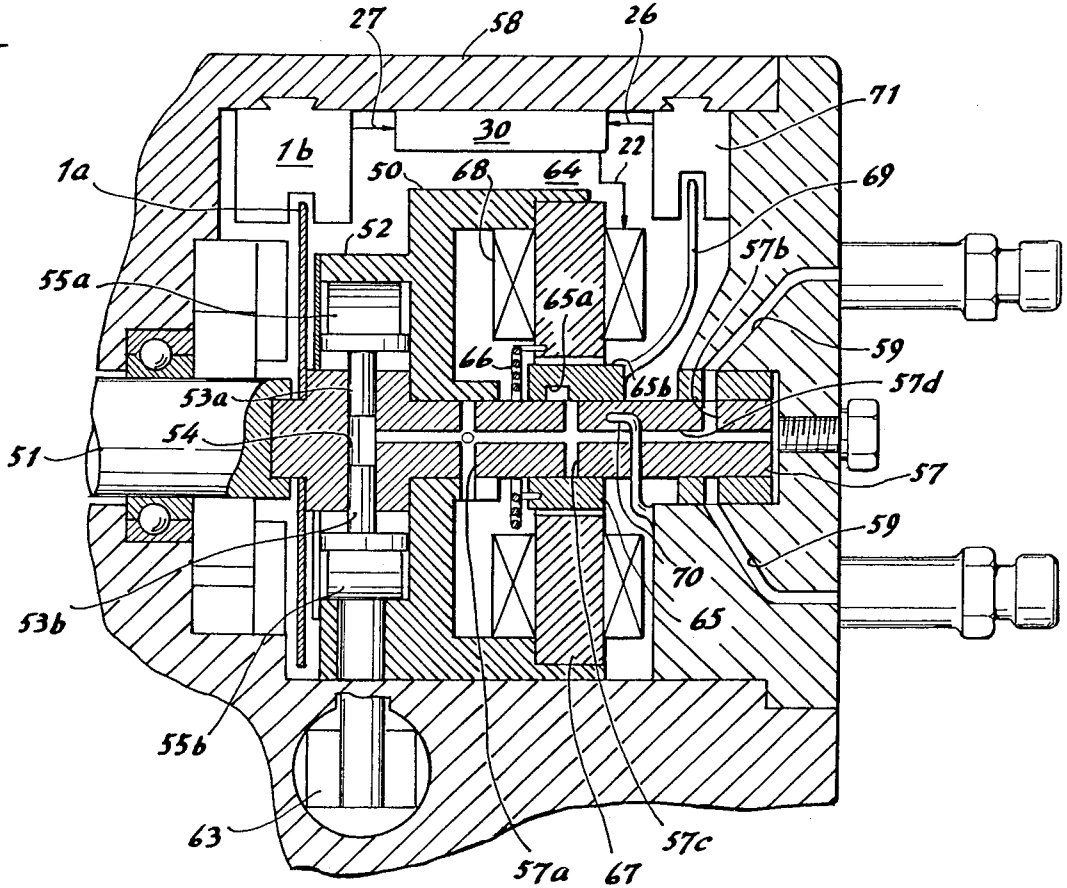
FIG. 6 is an axial cross-sectional view of a fuel injection pump according to a second embodiment of the invention.

The rotary solenoid can also be employed in a fuel injection pump of the type as shown at 64 in FIG. 6 wherein an inner cam ring and a pair of cam-engaging pistons are employed for effecting fuel compression at the rear end of a fuel distribution plunger without reciprocating it.

In FIG. 6, the solenoid 64 is supported in an angularly adjustable position by means of a yoke 50 which is rotatable about the axis of the drive shaft 1 by the hydraulically operated timimg arrangement 63. The yoke 50 is integrally formed with an inner cam ring 52 having an inner wall contoured to provide a plurality of inwardly facing camming faces that correspond in number to engine cylinders. A fuel distribution plunger 57 extends through the yoke 50 and is coupled with the drive shaft 51 for rotation therewith. A pair of radially reciprocable pistons 53*a* and 53*b* are mounted in a cylinder 54 which is formed at the rear end portion of the plunger 57 in communication with a bore 57*d* that extends axially to the forward end of plunger 57. The pistons 53*a* and 53*b* are provided with cam followers 55*a* and 55*b* respectively which are brought into camming contact with the inwardly facing camming surfaces of the cam ring 52 to reciprocate at fuel injection timing.

The plunger 57 is provided with radially extending fuel induction ports 57*a* each of which aligns with a fuel intake port, not shown, provided in the pump housing 58, fuel distribution ports 57*b* near the forward end thereof and spill ports 57*c* intermediate the ports 57*a* and ports 57*b*, the number of ports in each set corresponding to the number of engine cylinders.

Fuel supplied to one of induction ports 57*a* is led to the chamber 54 and compressed by the reciprocating pistons 53*a* and 53*b*, the compressed fuel being fed to the forward end of the plunger 57 when the pistons move radially outwards and delivered through one of the distribution ports 57*b*. The latter comes into alignment with an associated one of fuel delivery passages 59 to inject the compressed fuel to an engine cylinder. This timing is determined by the angular position of the yoke 50 and hence the fuel distribution ports 57*b* with respect to the fuel delivery passages 59 under the control of the timing means 63.

Since the rotary solenoid 64 is mounted in an angularly adjustable position, the reference position of the spill ring 57 is also rotatable with the inner cam ring 52 and hence with the variable injection start timing. The benefit of this arrangement is that the amount of fuel injected is not affected by the injection start timing adjustment. With this start timing correction, the fuel injection quantity is solely determined by the injection end timing and hence by the signal supplied from the control unit 30.

While the solenoid 64 may be of the identical construction to the solenoid 14 of the previous embodiment, this solenoid is not satisfactory for certain applications which require high precision control on the angular position of the spill ring. More specifically, in the FIG. 1 embodiment the angular displacement of the spill ring 15 that is required to vary the fuel injection quantity from a mininum to a maximum value is represented by the difference between the angular displacement of the spill ring 15 set for a minimum quantity and that for a maximum quantity. Because of the axially straight spill groove 15*b*, this difference is small compared with either of these angular displacements. If use is made of a fuel injection pump capable of fuel injection under a pressure of 500 kg/cm$^2$, for example, the amount of fuel injected per piston stroke typically varies in a range from a minimum of 7 mm$^3$ to a maximum of 40 mm$^3$, which range roughly corresponds to an angular displacement of 5 degrees. If this range is to be divided into 50 units of resolution, the spill ring 15 will be required to have a unit angular displacement as small as 0.1 degrees. This would require a costly, high precision position detector.

Figure 7:
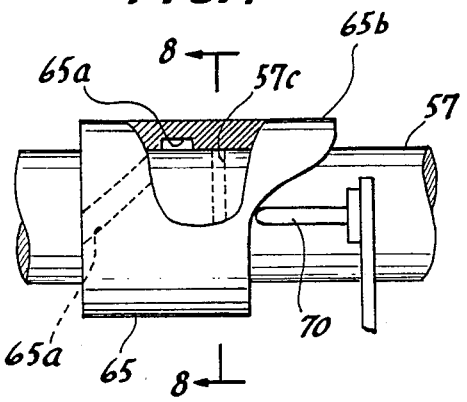
FIG. 7 is a partially broken, side view of the spill ring of the second embodiment.
Figure 8:
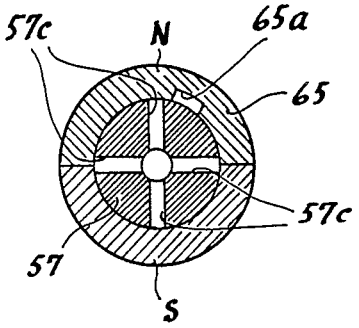
FIG. 8 is a cross-sectional view taken along lines 8—8 of FIG. 7.

To this end, the invention provides a rotary solenoid 64 which includes a rotary spill ring 65 of a structure differing from the spill ring 15 of the previous embodiment in that a part-helical spill groove 65*a* is provided on the inner wall thereof and a cam 65*b* is formed at the forward end thereof as clearly shown in FIGS. 7 and 8. The spill ring 65 is maintained in a home position by a spiral spring 66 which provides a biasing action both in angular and axial directions. A cam pin 70 is stationarily mounted in the housing 58 in camming contact with the cam portion 65*b* of the spill ring 65. The spill ring 65 rotates with respect to the stator core 67 in response to the current supplied to coils 68 from the control unit 30 in the same manner as in the previous embodiment. A ring position needle 69 extends from the spill ring 65 to a position detector 71 to detect the angular displacement of ring 65 with respect to a reference point.

Figure 9:
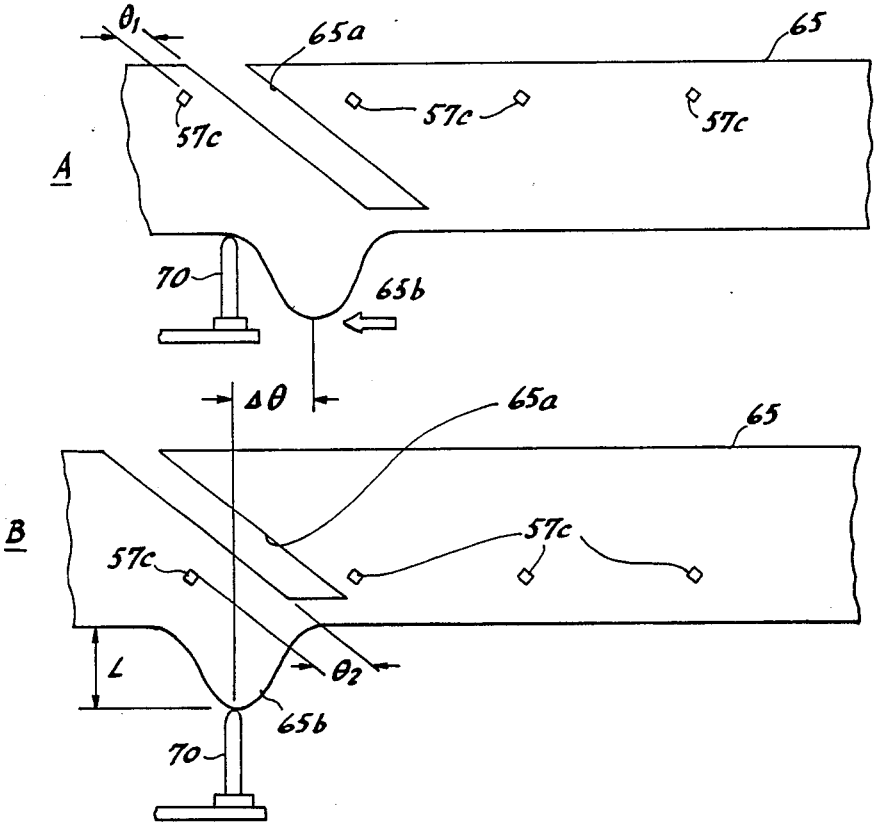
FIG. 9 is an illustration of a developed form of the spill ring of FIG. 7 useful for describing the second embodiment.

The operation of the rotary solenoid 65 will be better understood with reference to FIG. 9 in which the inner wall of the spill ring 65 is shown in developed form in relation to spill ports 57*c* of the rotary plunger 57.

The spill ring shown at A in FIG. 9 is positioned so that its cam portion 65*b* is located on the right side of the cam pin 70 to provide a minimum amount of fuel injection, while the spill ring shown at B in FIG. 9 is in a position rotated clockwise relative to the cam pin 70 for maximum amount of fuel injected. With the spill ring 65 located as shown at A, FIG. 9, it is assumed that fuel injection occurs, so that fuel injection will terminate when the spill ring 65 has rotated counterclockwise by an angle $\theta 1$ at which the spill port 57*c* coincides with the spill port 65*b*. In response to a current supplied to the coils 67, the spill ring 65 is rotated counterclockwise from the position A by an angle $\Delta\theta$ and is simultaneously displaced axially rearwards against the spring 66 by a maximum distance L due to the camming action. The spill port 57*c* is now positioned close to the forward end of the spill ring 65. If fuel injection occurs with the spill ring 65 in the position B, then the amount of injected fuel is proportional to an angle $\theta 2$. It is appreciated therefore that by rotating the spill ring 65 by appropriately choosing the angle of skew of spill port 65*a* and the amount of axial displacement L, the apparatus as taught by the invention allows a high resolution between minimum and maximum amounts of fuel injection. As a result, the position needle 69 swings through a larger angle than is available for the position needle 24 of the previous embodiment.

What is claimed is:

1. A fuel injection pump, comprising:

a compression chamber adapted to be coupled to a source of fuel;

a plurality of fuel injection nozzles;

a rotary plunger rotatably driven by an internal combustion engine, the plunger including means for defining a common passageway connected at one end to said compression chamber, said plunger further including means for defining a plurality of angularly spaced apart spill ports branching off said common passageway to an outside surface thereof and a fuel delivery port branching off said common passageway, the fuel delivery port being selectively movable into and out of alignment with each one of said nozzles by rotation of the plunger;

a magnetized rotary ring including means for defining a spill groove extending along the inner wall thereof, said ring being mounted on said plunger and rotatable, with respect to said plunger, between at least a first angular position whereat said spill groove is out of alignment with said spill ports to establish a pressure tight relationship between the inner wall of said ring and the outer wall of said plunger and a second angular position whereat said groove is in alignment with at least one of said spill ports to provide a pressure relief action, said ring comprising a cylindrical structure having differently magnetized equally divided arcuate sections, said groove being formed on the inner wall of the cylindrical structure and substantially axially extending from one end of the structure;

spring means for biasing said ring toward one of said first and second angular positions;

a stationary core surrounding said ring; and a coil wound on said core for generating a rotative thrust on said ring for selectively moving said ring between said first and second angular positions in response to a control signal.

2. A fuel injection pump as claimed in claim 1, wherein the spill groove is an axial groove formed on the inner wall of the cylindrical structure at one end thereof.

3. A fuel injection pump as claimed in claim 2, wherein said plunger is formed of a ferromagnetic material.

4. A fuel injection pump as claimed in claim 1, further comprising means for detecting the angular position of said magnetized ring.

5. A fuel injection pump as claimed in claim 4, wherein said ring is axially movably mounted on said plunger, and wherein said spill groove is a part-helical groove formed on the inner wall thereof, said ring being provided with a cam means for axially displacing the ring in proportion to the angle of rotation thereof, whereby the angular displacement of said ring with respect to said reference angular position is greater than the angular displacement of said spill groove with respect to said spill ports.

6. A fuel injection pump comprising:

a housing having a fuel inlet passage, a plurality of fuel delivery passages associated respectively with the cylinders of a multi-cylinder internal combustion engine, means defining a compression chamber, and means for compressing the fuel in said chamber in synchronism with the rotation of said engine;

a plunger adapted to be rotated in said housing by said engine, the plunger including means defining an axially extending bore connected at one end to said compression chamber, means defining a plurality of angularly spaced apart fuel inlet ports alignable with said fuel inlet passage for introducing fuel to said compression chamber, means defining a fuel distribution port for distributing the compressed fuel through said bore to each one of said fuel delivery passages, and means defining a plurality of angularly spaced apart spill ports connected to said bore for allowing said compressed fuel to escape to the outside of said plunger; and a rotary solenoid having a stator core, a coil wound on said core adapted to be energized by a current supplied thereto, a magnetized ring including means defining a spill groove, and spring means for resiliently maintaining said ring in a reference angular position with respect to said stator core, said magnetized ring being mounted on said plunger so that said ring can rotate from said reference angular position to an angularly displaced position in proportion to the magnetic flux of said coil to align said spill groove with each spill port of said plunger to create a passageway for said escaping fuel, said ring comprising a cylindrical structure having differently magnetized, equally divided arcuate sections, said spill groove being formed on the inner wall of the cylindrical structure and substantially axially extending from one end of the structure.

7. A fuel injection pump as claimed in claim 6, wherein said plunger is formed of a ferromagnetic material.

8. A fuel injection pump as claimed in claim 6, further comprising means for detecting the angular position of said magnetized ring.

9. A fuel injection pump as claimed in claim 8, wherein said ring is axially movably mounted on said plunger, and wherein said spill groove comprising a part-helical groove formed on the inner wall thereof, said ring being provided with a cam means for axially displacing the ring in proportion to the angle of rotation thereof, whereby the angular displacement of said ring with respect to said reference angular position is greater than the angular displacement of said spill groove with respect to said spill ports.

10. A fuel injection pump as claimed in claim 6, further comprising an inner cam ring mounted at an angularly adjustable position and means for moving said cam ring to a desired angular position, said cam ring having a plurality of inwardly facing cam surfaces, wherein said compression means comprises a pair of pistons reciprocably located in said compression chamber in camming contact with each pair of said cam surfaces, said rotary solenoid being coupled to said cam ring for rotation therewith.

11. A fuel injection pump as claimed in claim 10, wherein said compression chamber is formed in said plunger at a position adjacent to one end thereof to cause said pistons to rotate with said plunger.

12. A fuel injection pump as claimed in claim 6, further comprising a face cam secured to one end of said plunger and adapted to be axially movably coupled to an output shaft of said engine, a cam follower, means for mounting said cam follower in camming contact with said face cam in an angularly adjustable, axially stationary position, so that said plunger is axially movable in synchronism with the rotation of said engine, and wherein said compression chamber is formed in a position adjacent to the other end of said plunger.

13. An apparatus for selectively opening a spill port defined in the cylindrical plunger of a fuel injection pump, comprising:

sleeve means, encircling at least a portion of said plunger, for rotating with respect to said plunger between at least first and second predetermined angular positions, said sleeve means including means for defining at least one spill groove selectively in registry with said spill port defined in said plunger, said registry dependent upon the angular position of said sleeve means with respect to said plunger, said sleeve means including means for producing a first magnetic field, said first field-producing means comprising at least two magnetic sections integral to said sleeve means, said sections permanently magnetized to different polarities; and second magnetic field producing means for selectively producing a second magnetic field in response to a control signal applied thereto, said second magnetic field interacting with said first magnetic field to control the angular position of said sleeve means.

14. An apparatus as in claim 13 further comprising biasing means for resisting rotation of said sleeve means in a first direction of rotation, said second magnetic field causing said sleeve means to rotate in said first direction.

15. An apparatus as in claim 14 wherein:

said spill groove is at least partially helical in shape;

said sleeve means is also axially slidable along said plunger between at least first and second axial positions; and said biasing means also biases said sleeve means toward said first axial position.

16. An apparatus as in claim 15 wherein said sleeve means further includes cam means, defined on an end surface thereof, for selectively changing the axial position of said sleeve means in response to rotation of said sleeve means.

17. An apparatus as in claim 13 wherein said second magnetic field producing means comprises:

a stator core stationarily mounted in respect to said sleeve means; and at least one coil means, wound on said core and connected to receive said control signal, for conducting electrical current.

18. A fuel injection pump including:

means defining a chamber;

plunger means for selectively decreasing the volume of said chamber, said plunger means including means for defining at least one passage therethrough for conducting a flow of fuel to and from said chamber, and means for defining at least one spill port connected to said passage;

sleeve means, encircling at least a portion of said plunger means, for rotating with respect to said plunger means between at least first and second predetermined angular positions, said sleeve means including spill groove means, selectively in registry with said spill port in dependence upon the angular position of said sleeve means, for exhausting fuel from said passage via said spill port, said sleeve means including means for producing a first magnetic field, said first field producing means comprising at least two magnetic sections integral to said sleeve means, said sections permanently magnetized to different polarities; and second magnetic field producing means for selectively producing a magnetic field in response to a control signal applied thereto, said second magnetic field interacting with said first magnetic field to control the angular position of said sleeve means.

19. A pump as in claim 18 wherein said plunger means comprises a material which minimizes disturbances in the magnetic flux lines of said first and second magnetic fields.

20. A pump as in claim 18 further comprising biasing means for resisting rotation of said sleeve means in a first direction, said second magnetic field causing said sleeve means to rotate in said first direction.

21. A pump as in claim 20 wherein:

said spill groove is at least partly helical in shape;

said sleeve means is also axially slidable along said plunger means between at least first and second axial positions; and said biasing means also biases said sleeve means toward said first axial position.

22. A pump as in claim 21 wherein said sleeve means further includes cam means, defined on an end surface thereof, for selectively changing the axial position of said sleeve means in response to rotation of said sleeve means.

23. A pump as in claim 18 wherein said second magnetic field producing means comprises:

a stator core stationarily mounted in respect to said sleeve means; and at least one coil means, wound on said core and connected to receive said control signal, for conducting electrical current.

* * * * *